US007585553B2

(12) United States Patent
Burch et al.

(10) Patent No.: US 7,585,553 B2
(45) Date of Patent: Sep. 8, 2009

(54) INKJET MEDIA COATING WITH IMPROVED LIGHTFASTNESS, SCRATCH RESISTANCE, AND IMAGE QUALITY

(75) Inventors: Eric L Burch, San Diego, CA (US); Yubai Bi, San Diego, CA (US); Pierre-Alain Brugger, Ependes (CH); Martin Staiger, Clarens (CH)

(73) Assignee: Hewlett-Packard Development Company, L.P., Houston, TX (US)

( * ) Notice: Subject to any disclaimer, the term of this patent is extended or adjusted under 35 U.S.C. 154(b) by 150 days.

(21) Appl. No.: 10/155,185

(22) Filed: May 24, 2002

(65) Prior Publication Data

US 2003/0219551 A1 Nov. 27, 2003

(51) Int. Cl.
*B41M 5/00* (2006.01)

(52) U.S. Cl. ..... 428/32.25; 428/32.31; 428/32.34; 428/32.35; 428/32.36

(58) Field of Classification Search ..... 428/32.25, 428/32.34, 32.35, 32.36, 32.31
See application file for complete search history.

(56) References Cited

U.S. PATENT DOCUMENTS

| | | | | |
|---|---|---|---|---|
| 4,780,356 | A | 10/1988 | Otouma et al. | |
| 4,879,166 | A | 11/1989 | Misuda et al. | |
| 5,104,730 | A | 4/1992 | Misuda et al. | |
| 5,463,178 | A | 10/1995 | Suzuki et al. | |
| 5,750,200 | A * | 5/1998 | Ogawa et al. | 427/361 |
| 5,910,359 | A * | 6/1999 | Kobayashi et al. | 428/327 |
| 5,985,425 | A * | 11/1999 | Tomizawa et al. | 428/212 |
| 6,156,419 | A | 12/2000 | Brugger et al. | |
| 6,203,899 | B1 * | 3/2001 | Hirose et al. | 428/341 |
| 6,242,082 | B1 * | 6/2001 | Mukoyoshi et al. | 428/32.18 |
| 6,245,422 | B1 * | 6/2001 | Onishi et al. | 428/331 |
| 6,319,591 | B1 | 11/2001 | Malhotra | |
| 2003/0072925 | A1 * | 4/2003 | Kiyama et al. | 428/195 |

FOREIGN PATENT DOCUMENTS

| | | |
|---|---|---|
| EP | 0 298 424 | 12/1994 |
| EP | 0 407 720 | 8/1995 |
| EP | 0 622 244 | 7/1997 |
| EP | 1 000 767 | 8/2001 |
| EP | 1 120 280 | 8/2001 |
| JP | 60-245588 | 12/1985 |

* cited by examiner

*Primary Examiner*—Betelhem Shewareged

(57) ABSTRACT

An inkjet receiver layer is constructed of an alumina-containing layer also containing a binder with an essentially binder-free, colloidal, cationic silica top-coat. The colloidal cationic silica topcoat provides improved image quality (color gamut and gloss) and increased resistance to scratching, while maintaining a high absorption of ink.

21 Claims, No Drawings

INKJET MEDIA COATING WITH IMPROVED LIGHTFASTNESS, SCRATCH RESISTANCE, AND IMAGE QUALITY

TECHNICAL FIELD

The present invention relates generally to printing media used in inkjet printing, and, more particularly, to coatings on said print media having improved lightfastness, scratch resistance, and image quality.

BACKGROUND ART

In recent years, as digital cameras and other devices having color output have advanced, the technology has attempted to keep pace in order to record images on paper sheets or the like. The ultimate goal of such recorded images ("hard copy") is silver halide photography, and it is desired to provide recorded images from such devices that have the color reproduction, image density, gloss, etc. as close to those of silver halide photography as possible.

The technology of inkjet color printing has attempted to keep pace with the development of digital cameras and other color output devices, but improvements are continually sought in order to be competitive with silver halide images.

Recording sheets for the inkjet printing process available today do not have all the properties required. In particular, there is a need to improve ink absorptiveness, ink absorption rate, image quality, water fastness and light stability. Specifically, ink-receiving materials are sought where the images recorded thereon are resistant to rubbing on the surface and remain intact when in contact with water and should not fade when exposed to light.

It is known that recording sheets for inkjet printing must meet a number of stringent demands. The printed image has to fulfill the following properties: high resolution; high color density; good color reproduction; high resistance to rubbing; good water fastness; and high light stability.

The following conditions have to be met to fulfill these goals:

1. The ink needs to be absorbed quickly into the recording material;
2. The jetted ink droplets have to spread circularly on the recording material and have to form well-defined edges;
3. Dye diffusion in the recording material has to be low so that the diameter of the color points is not increased more than necessary;
4. An ink droplet is not allowed to interfere with a droplet deposited earlier nor should it blur it;
5. The recording material needs to have a surface that gives high color density and brilliance; and
6. The recording material has to show excellent physical properties before and after printing.

These requirements are partially contradictory; for example, a fast ink absorption rate often results in poor resistance to rubbing of the surface.

Starting from these requirements for a recording material, the best recording material comprises an ink-receiving coating on a support. Examples of such recording materials are disclosed, for example, in patents EP 0 298 424 and EP 0 407 720, and patent applications EP 0 622 244 and JP 60-245,588. These references disclose ink-receiving layers that include as pigment aluminum oxide/hydroxide with a pseudo-boehmite structure. Pseudo-boehmite is an agglomerate of aluminum oxide/hydroxide $Al_2O_3.n\,H_2O$ where n is from 1 to 1.5. Preferably, this aluminum oxide/hydroxide with a pseudo-boehmite structure is used in the form of its colloidal solution, which provides recording materials with superior image quality. It is well known that such colloidal solutions are only stable at low concentrations of the active ingredient. The storage stability of such colloidal solutions is low and storage conditions have to be tightly controlled.

However, ink receiving layers prepared with aluminum oxide/hydroxide isolated in its solid form from its colloidal solution give images after inkjet printing with a reduced image quality compared with ink receiving layers prepared with the same aluminum oxide/hydroxide in the form of its colloidal solution.

EP 1 000 767 and U.S. Pat. No. 6,156,419 disclose a plurality of layers on a support, wherein one coated layer comprises a porous aluminum oxide/hydroxide containing at least one element of the rare earth metal series of the Periodic Table of the elements with atomic numbers 57 to 71. However, there is no topcoat on the pseudo-boehmite. The rare-earth modified alumina layer is said to have improved lightfastness and image homogeneity, compared to an alumina layer without the rare earth. However, gloss, color gamut, and scratch resistance are poor without a topcoat.

U.S. Pat. No. 5,463,178 describes a silica topcoat on alumina; however, a binder is used which decreases ink adsorption and the silica is anionic, which decreases ink holdout.

An inkjet recording sheet is required that avoids most, if not all, of the foregoing problems, while addressing the needs of photographic-quality prints.

DISCLOSURE OF INVENTION

In accordance with the embodiments disclosed herein, an alumina-based layer containing a binder is topcoated with a binder-free cationic silica layer.

The combination of alumina layer topcoated with a cationic silica layer provides a recording media with improved color gamut, improved gloss, and improved scratch resistance while maintaining a high ink adsorption rate.

BEST MODES FOR CARRYING OUT THE INVENTION

Reference is now made in detail to specific embodiments of the present invention, which illustrates the best mode presently contemplated by the inventors for practicing the invention. Alternate embodiments are also briefly described as applicable.

In accordance with the various embodiments disclosed herein, a basecoat formed on a substrate comprises an alumina layer with a polymeric binder coated with a colloidal cationic silica topcoat that is essentially free of polymeric binder.

The basecoat ink-receiving layer is formed on a substrate, or support. The usual supports used in the manufacture of transparent or opaque photographic material may also be employed in the practice of the present invention. Examples include, but are not limited to, clear films, such a cellulose esters, including cellulose triacetate, cellulose acetate, cellulose propionate, or cellulose acetate butyrate, polyesters, including poly(ethylene terephthalate), polyimides, polycarbonates, polyamides, polyolefins, poly(vinyl acetals), polyethers, polyvinyl chloride, and polysulfonamides. Polyester film supports, and especially poly(ethylene terephthalate), such as manufactured by du Pont de Nemours under the trade designation of MELINEX, are preferred because of their excellent dimensional stability characteristics. Opaque photographic materials include, for example, baryta paper, poly-ethylene-coated papers, and voided polyester. Especially preferred are resin-coated paper or voided polyester.

Non-photographic materials, such as transparent films for over-head projectors, may also be used for the support material. Examples of such transparent films include, but are not limited to, polyesters, diacetates, triacetates, polystyrenes, polyethylenes, polycarbonates, polymethacrylates, cellophane, celluloid, polyvinyl chlorides, polyvinylidene chlorides, polysulfones, and polyimides.

Additional support materials include plain paper of various different types, including, but not limited to, pigmented papers and cast-coated papers, as well as metal foils, such as foils made from alumina.

The silica topcoat comprises particles that have a particle size within the range of about 5 to 500 nm, preferably about 5 to 100 nm. The thickness of the topcoat layer is within the range of about 0.01 to 2 μm, preferably about 0.04 to 1 μm.

The use of certain support materials, such as polyesters, is beneficially improved with use of a subbing layer, which improves the bonding of the ink receiving layers to the support. Useful subbing compositions for this purpose are well known in the photographic art and include, for example, terpolymers of vinylidene chloride, acrylonitrile, and acrylic acid or of vinylidene chloride, methyl acrylate, itaconic acid, and natural polymers such as gelatin.

The basecoat layer is formed on the substrate (or subbing layer, as the case may be). The basecoat layer comprises alumina and a binder.

Preferably, the basecoat layer comprises pseudo-boehmite, which is aluminum oxide/hydroxide ($Al_2O_3.n\,H_2O$ where n is from 1 to 1.5). Most preferably, the basecoat layer comprises rare earth-modified boehmite, containing from about 0.04 to 4.2 mole percent of at least one rare earth metal having an atomic number from 57 to 71 of the Periodic Table of Elements. Preferably, the rare earth elements are selected from the group consisting of lanthanum, ytterbium, cerium, neodymium, and praseodymium. Most preferably, the rare earth elements are selected from the group consisting of lanthanum, cerium, and ytterbium and mixtures thereof. The presence of the rare earth changes the pseudo-boehmite structure to the boehmite structure. The presence of the rare earth element provides superior lightfastness, compared with an alumina base-coat not including the rare earth element.

The preparation of the pseudo-boehmite layer modified with rare earths is more fully described in U.S. Pat. No. 6,156,419, the contents of which are incorporated herein by reference.

The alumina basecoat includes one or more binders. These binders are normally water-soluble. Especially preferred are film-forming polymers, natural or synthetic. The amount of binder in the basecoat ranges from about 5 to 50 wt % relative to the alumina.

Examples of water-soluble polymers useful as binders include, for example, natural polymers or modified products thereof such as albumin; gelatin; casein; starch; gum arabicum; sodium or potassium alginate; hydroxyethylcellulose; carboxymethylcellulose; α-, β-, or γ-cyclodextrine; and the like. In the case where one of the water-soluble polymers is gelatin, all known types of gelatin may be used, such as, for example, acid pigskin or limed bone gelatin, acid- or base-hydrolyzed gelatin, as well as derivatized gelatins such as phthalaoylated, acetylated, or carbamoylated gelatin or gelatin derivatized with the anhydride of trimellytic acid. A preferred natural binder is gelatin.

Synthetic polymers are also used and include, but are not limited to, polyvinyl alcohol; completely or partially saponified products of copolymers of vinyl acetate and other monomers; homopolymers of or copolymers with monomers of unsaturated carboxylic acids such as (meth)acrylic acid, maleic acid, crotonic acid, and the like; and homopolymers of or copolymers with vinyl monomers of sulfonated vinyl monomers such as vinylsulfonic acid, styrene sulfonic acid, and the like. Additional synthetic polymers include homopolymers of or copolymers with vinyl monomers of (meth)acrylamide; homopolymers or copolymers of other monomers with ethylene oxide; polyurethanes; polyacrylamides; water-soluble nylon-type polymers; polyvinyl pyrrolidone; polyesters; polyvinyl lactams; acrylamide polymers; substituted polyvinyl alcohol; polyvinyl acetals; polymers of alkyl and sulfoalkyl acrylates and methacrylates; hydrolyzed polyvinyl acetates; polyamides; polyvinyl pyridines; polyacrylic acid; copolymers with maleic anhydride; polyalkylene oxides; methacrylamide copolymers; and maleic acid copolymers. All these polymers can also be used as mixtures. A preferred synthetic binder is polyvinyl alcohol.

The basecoat may contain in addition to the binder and alumina a crosslinking agent for the binder as well as fillers, natural or synthetic polymers or other compounds well known to someone skilled in this art to improve the pictorial or physical properties of the image, such as for example UV absorbers, optical brighteners, light stabilizers, antioxidants, humefactants, surfactants, spacing agents, plasticizers, and the like. The thickness of the basecoat layer ranges from about 0.5 to 100 μm dry thickness, and preferably from about 20 to 70 μm.

Turning now to a discussion of the preferred embodiments, a top-coat layer of binder-free, colloidal cationic silica is formed on top of the alumina/binder basecoat layer. By "binder-free" is meant that less than 4 wt % of pigment (silica) comprises a binder material deliberately added to the pigment, preferably, less than 1 wt %, and most preferably, 0 wt %.

The silica topcoat comprises particles that have a particle size within the range of about 5 to 500 nm, preferably about 10 to 100 nm. The thickness of the topcoat layer is within the range of about 0.01 to 2 μm, preferably about 0.04 to 1 μm. Colloidal cationic silica is commercially available from a variety of vendors, including Clariant Corp. (Charlotte, N.C.) available under the following tradenames: Cartacoat 302C, and Cartacoat 303C; and Nissan Chemical Corp., available under the tradenames of Snowtex O, Snowtex OL, and Snowtex OXS, among others. The topcoat may contain any of the same additional components as listed above for the basecoat.

The basecoat layer disclosed and claimed herein is intended for use with ink jet inks. Such inks, as is well known, comprise at least one colorant and a vehicle. The use of the cationic silica is intended for use with dye-based inks, specifically, anionic dyes. Such anionic dyes are, per se, well known, and any of the anionic dyes employed in ink jet inks, including color and black, may be advantageously utilized in the practice of the embodiments disclosed herein. Indeed, the recording sheet herein is preferably employed in conjunction with ink jet inks containing anionic dyes, and beneficially improves the properties of such inks upon printing, due to the presence of the cationic silica topcoat. Preferably, carboxylate and sulfonate anionic dyes are employed in the ink jet inks used in conjunction with the recording sheet disclosed and claimed herein.

In formulating the ink-jet inks used with the recording sheet disclosed and claimed herein, water, alone or together with one or more co-solvents, may be employed in the vehicle. These co-solvents are substantially water-miscible. Classes of co-solvents employed in the practice of this invention include, but are not limited to, aliphatic alcohols, aromatic alcohols, diols, glycol ethers, poly(glycol) ethers, caprolactams, formamides, acetamides, and long chain alcohols. Examples of generic co-solvents employed in the inks include, but are not limited to, primary aliphatic alcohols of 30 carbons or less, primary aromatic alcohols of 30 carbons or less, secondary aliphatic alcohols of 30 carbons or less, secondary aromatic alcohols of 30 carbons or less, 1,2-alcohols of 30 carbons or less, 1,3-alcohols of 30 carbons or less, l,e-alcohols of 30 carbons or less, ethylene glycol alkyl ethers, propylene glycol alkyl ethers, poly(ethylene glycol) alkyl ethers, higher homologs of poly(ethylene glycol) alkyl ethers, poly(propylene glycol) alkyl ethers, higher homologs of poly(propylene glycol) alkyl ethers, N-alkyl caprolactams, unsubstituted caprolactams, substituted formamides, unsubstituted formamides, substituted acetamides, and unsubstituted acetamides. Specific examples of co-solvents that are preferably employed in the inks include, but are not limited to, N-methyl pyrrolidone, 1,5-pentanediol, 2-pyrrolidone, diethylene glycol, 1,3-(2-methyl)-propanediol, 1,3,5-(2-methyl)-pentanetriol, tetramethylene sulfone, 3-methoxy-3-methylbutanol, glycerol, and 1,2-alkyldiols. The co-solvent concentration may range from 0 to about 30 wt %, with about 3 to 15 wt % being preferred.

In addition to the foregoing, various types of additives may be employed in the ink to optimize the properties of the ink for specific applications. For example, as is well-known to those skilled in the art, biocides may be used in the ink to inhibit growth of microorganisms, sequestering agents such as EDTA may be included to eliminate deleterious effects of heavy metal impurities, buffering agents may be used to control the pH of the ink, and acrylic or non-acrylic polymers may be added to condition the ejected ink droplets. Other known additives such as viscosity modifiers, e.g., surfactants, optical brighteners, UV absorbers, light stabilizers, ink penetration agents, leveling agents, and drying agents, may be added to improve various properties of the ink compositions as desired. The organic components have, in most cases, a boiling point that is higher than that of water.

The dyes suitable for the preparation of inks useable with the recording sheets disclosed and claimed herein cover practically all classes of known coloring compounds. The recording sheets herein are meant to be used in conjunction with most of the inks representing the state of the art.

The cationic silica serves to hold the anionic dye in the topcoat. Consequently, a relatively high amount of color is maintained in the topcoat, close to the surface of the recording sheet, thereby increasing the color gamut and resulting in higher chroma. The combination of the cationic silica and anionic dye serves to "fix" the dye, and render it comparatively color fast.

The lower alumina-containing basecoat serves to attract the solvent(s) comprising the vehicle, thereby aiding in relatively rapid drying of the printed ink.

The combination of the rare-earth element modified alumina layer topcoated with a cationic silica layer provides a recording material with improved lightfastness, improved image quality, and improved scratch resistance while maintaining a high ink absorption rate. Even without the rare earth element, the presence of the cationic silica topcoat provides a recording material having improved image quality and improved scratch resistance, while maintaining a high ink absorption rate.

EXAMPLES

Example 1

A recording sheet was prepared as follows: a substrate comprising a resin-coated photobase material was coated with a basecoat comprising the following composition:

| Concentration | Material | Product Designation and Source |
|---|---|---|
| 41 g/m$^2$ | Alumina | Sasol HP14-2 |
| 4.0 g/m$^2$ | Polyvinyl alcohol binder | Mowiol 5689 |
| 0.8 g/m$^2$ | Lactic acid | Aldrich |
| 0.5 g/m$^2$ | Glycerol | Aldrich |
| 0.5 g/m$^2$ | Boric acid | Aldrich |
| 0.4 g/m$^2$ | Trimethylolpropane | Aldrich |
| 0.2 g/m$^2$ | Surfactant | Triton X100 |

The basecoat was formed by dispersing the alumina in water with lactic acid, the PVA binder was dissolved in water, then to the dispersion was added the PVA binder and then the other ingredients were added with stirring.

The basecoat was then coated on the substrate by curtain-coating, although any method known in the art could have been used with essentially the same results.

The coated recording sheet was then coated with a topcoat comprising 0.25 g/m$^2$ colloidal cationic silica, available from Clariant under the trade designation Cartacoat 302C (mean silica particle size=25 nm).

The coating of the topcoat was done during the same curtain-coating step as the basecoat.

Alternatively, the basecoat could be applied to the substrate, then dried, then the top coat applied to the basecoat, then dried, using single slot coating.

Example 2

A recording sheet with basecoat was processed in a similar manner as Example 1, but with a topcoat comprising 1.0 g/m$^2$ Cartacoat 302C (Clariant), which has a mean particle size of 25 nm.

The coating of the topcoat was done as in Example 1.

Example 3

A recording sheet with basecoat was processed in a similar manner as Example 1, but with a topcoat comprising 1.0 g/m$^2$ Cartacoat 303C (Clariant), which has a mean particle size of 50 nm.

The coating of the topcoat was done as in Example 1.

Comparative Example 1

The coated recording sheet with basecoat of Example 1 was prepared, but was not provided with a topcoat for comparative purposes.

Comparative Example 2

A recording sheet was prepared as in Comparative Example 1, but using a substrate comprising MELINEX film (a poly(ester terephthalate)) in place of resin photobase material.

Example 4

A recording sheet was prepared as follows: a substrate comprising a MELINEX film was coated with a basecoat comprising the following composition:

| Concentration | Material | Product Designation and Source |
|---|---|---|
| 37 g/m$^2$ | Alumina | Sasol HP14-2 |
| 3.6 g/m$^2$ | Polyvinyl alcohol binder | Mowiol 5689 |
| 0.7 g/m$^2$ | Lactic acid | Aldrich |
| 0.5 g/m$^2$ | Glycerol | Aldrich |
| 0.5 g/m$^2$ | Boric acid | Aldrich |
| 0.4 g/m$^2$ | Trimethylolpropane | Aldrich |
| 0.2 g/m$^2$ | Surfactant | Triton X100 |

The basecoat was prepared as in Example 1 and was coated on the substrate as in Example 1.

The coated recording sheet was then coated with a topcoat comprising 0.15 g/m$^2$ Cartacoat 303C (Clariant), which has a mean particle size of 50 nm.

The coating of the topcoat was done as in Example 1.

Example 5

A recording sheet with basecoat was processed in a similar manner as Example 4, but with a topcoat comprising a mixture of 0.3 g/m$^2$ Cartacoat 303C and 0.7 g/m$^2$ Cartacoat 302C (a mixture of mean particle sizes of 50 and 25 nm, respectively).

The coating of the topcoat was done as in Example 1.

Comparative Example 3

A recording sheet was prepared as in Example 5, but the topcoat included 0.1 g/m$^2$ of Mowiol 5698 (polyvinyl alcohol binder) in addition to the mixture of silica.

Results.

The recording sheets from the various foregoing examples were printed on an ink jet printer with a standard color pattern, using a DeskJet 970 with cyan, magenta, yellow, blue, green red, and black squares, with the ink jet inks containing anionic dyes.

The results listed in the Table below were obtained with regard to color gamut (CIELAB), gloss, scratch resistance, and color smudge. Color gamut was measured with a Macbeth Color Eye 7000A color spectrophotometer. Gloss was measured at a 20 degree angle with a BYK Gardner Micro-TRI-Gloss. Scratch resistance was measured with a stainless steel stylus point with a 5 g weight. Color smudge was measured immediately after printing by swiping a finger across the print to determine relative dry time and wet coating integrity.

A higher color gamut is preferred to a lower color gamut and a higher gloss is preferred to a lower gloss. The scratch resistance, visual evaluation, is provided on a scale of 1 to 5, with 5 being excellent and 1 being poor.

The color smudge, also visual evaluation, is provided on a scale of 1 to 5, with 5 being excellent and 1 being poor.

| Example | CIELAB Gamut | Gloss | Scratch Resistance | Color Smudge |
|---|---|---|---|---|
| 1 | 374,000 | 34 | 3 | 5 |
| 2 | 404,000 | 37 | 4 | 5 |
| 3 | 367,000 | 34 | 5 | 5 |

-continued

| Example | CIELAB Gamut | Gloss | Scratch Resistance | Color Smudge |
|---|---|---|---|---|
| Comp. 1 | 364,000 | 31 | 3 | 5 |
| Comp. 2 | 368,000 | 34 | 2 | 5 |
| 4 | 378,000 | 39 | 3 | 5 |
| 5 | 383,000 | 50 | 3 | 5 |
| Comp. 3 | 384,000 | 48 | 3 | 3 |

Comparative Examples 1 and 2 (without the colloidal cationic silica topcoat) are seen to have a lower color gamut, a lower gloss, and a lower scratch resistance. The cationic silica topcoat does not slow down the absorption of the ink, as evidenced by the high color smudge resistance values. The binder in the silica topcoat (Comparative Example 3) is seen to slow down absorption of the ink, as evidenced by the lower color smudge resistance value.

The cationic silica topcoat further provided good adhesion of the topcoat to the basecoat and no visible defects to thereby provide a uniform film. Looking at individual dots under a microscrope—the silica topcoat provided dots that were larger in diameter and of more uniform color than in the absence of the topcoat.

Example 6

A recording sheet with basecoat is processed in a similar manner as Example 3, but with the addition of 0.2 g/m$^2$ of $La(NO_3)_3$ in the alumina basecoat.

The results obtained as to CIELAB gamut, gloss, scratch resistance, and color smudge are the same as those obtained for Example 2. The measured lightfastness is higher than that measured for Example 2.

Industrial Applicability

Thus, there has been disclosed a recording sheet for receiving ink, such as from an ink jet printer, having improved properties.

What is claimed is:

1. A recording sheet for ink jet printing comprising a support having coated on said support (1) a basecoat layer, said basecoat layer formed on said support and comprising an alumina-based composition containing at least one binder, and (2) a topcoat layer, formed on said basecoat layer, comprising a colloidal cationic silica composition, wherein said topcoat layer has a thickness within a range of about 0.14 to 0.57 μm, and the colloidal cationic silica composition comprises less than 1 weight percent of binder material.

2. The recording sheet of claim 1 wherein said basecoat layer is adapted to receive ink from an ink jet printer, said ink comprising a colorant and a vehicle.

3. The recording sheet of claim 2 wherein said colorant comprises an anionic dye.

4. The recording sheet of claim 1 wherein said basecoat layer additionally contains from about 0.04 to 4.2 mole percent of at least one rare earth metal.

5. The recording sheet of claim 4 wherein said at least one rare earth metal is selected from the group consisting of lanthanum, ytterbium, cerium, neodymium, and praseodymium.

6. The recording sheet of claim 1 wherein said topcoat layer comprises silica having a mean particle size of about 50 nm.

7. The recording sheet of claim 1 wherein said alumina-based composition comprises an aluminum oxide/hydroxide having a pseudo-boehmite structure.

8. The recording sheet of claim 1 wherein said topcoat layer comprises silica particles that have a mean particle size within the range of about 5 to 500 nm.

9. The recording sheet of claim 8 wherein said mean particle size of said silica is within a range of about 10 to 100 nm.

10. The recording sheet of claim 9 wherein said mean particle size is about 25 nm.

11. The recording sheet of claim 9 wherein said mean particle size is a mixture of about 25 nm and about 50 nm.

12. In combination, (a) a recording sheet for ink jet printing comprising a support having coated on said support a basecoat comprising an alumina-based composition containing at least one binder, and a topcoat layer, formed on said basecoat layer, comprising a colloidal cationic silica composition, wherein said topcoat layer has a thickness within a range and the colloidal cationic silica composition comprises less than 1 weight percent of binder material, and (b) an ink printed thereon, said ink comprising a colorant and a vehicle, wherein said colorant comprises an anionic dye.

13. The combination of claim 12 wherein said base-coat layer additionally contains from about 0.04 to 4.2 mole percent of at least one rare earth metal.

14. The combination of claim 13 wherein said at least one rare earth metal is selected from the group consisting of lanthanum, ytterbium, cerium, neodymium, and praseodymium.

15. The combination of claim 12 wherein said topcoat layer comprises silica having a mean particle size of about 50 nm.

16. The combination of claim 12 wherein said alumina-based composition comprises a aluminum oxide/hydroxide having a pseudo-boehmite structure.

17. The combination of claim 12 wherein said topcoat layer comprises silica particles that have a mean particle size within the range of about 5 to 500 nm.

18. The combination of claim 17 wherein said mean particle size is within a range of about 10 to 100 nm.

19. The combination of claim 17 wherein said mean particle size is about 25 nm.

20. The combination of claim 18 wherein said mean particle size is a mixture of about 25 nm and about 50 nm.

21. The combination of claim 12 wherein said anionic dye is a carboxylate or sulfonate dye.

* * * * *

UNITED STATES PATENT AND TRADEMARK OFFICE

CERTIFICATE OF CORRECTION

PATENT NO. : 7,585,553 B2
APPLICATION NO. : 10/155185
DATED : September 8, 2009
INVENTOR(S) : Eric L Burch et al.

It is certified that error appears in the above-identified patent and that said Letters Patent is hereby corrected as shown below:

In column 9, line 21, in Claim 12, after "range" insert -- of about 0.14 to 0.57 μm, --.

Signed and Sealed this

Thirteenth Day of July, 2010

David J. Kappos

David J. Kappos
*Director of the United States Patent and Trademark Office*